US011643880B2

(12) United States Patent
Beckhusen

(10) Patent No.: US 11,643,880 B2
(45) Date of Patent: May 9, 2023

(54) APPARATUS FOR CONNECTING A DRILL PIPE TO THE DRILLING DRIVE OF A DRILLING RIG, AND DRILLING ASSEMBLY FOR BOREHOLES COMPRISING SUCH AN APPARATUS

(71) Applicant: Sven Beckhusen, Buxtehude (DE)

(72) Inventor: Sven Beckhusen, Buxtehude (DE)

( * ) Notice: Subject to any disclaimer, the term of this patent is extended or adjusted under 35 U.S.C. 154(b) by 0 days.

(21) Appl. No.: 17/784,799

(22) PCT Filed: Dec. 10, 2020

(86) PCT No.: PCT/EP2020/085611
§ 371 (c)(1),
(2) Date: Jun. 13, 2022

(87) PCT Pub. No.: WO2021/116329
PCT Pub. Date: Jun. 17, 2021

(65) Prior Publication Data

US 2023/0008314 A1 Jan. 12, 2023

(30) Foreign Application Priority Data

Dec. 12, 2019 (DE) ..... 102019134109.4
Dec. 12, 2019 (DE) ..... 202019106925.2

(51) Int. Cl.
*E21B 17/03* (2006.01)
*E21B 17/046* (2006.01)

(52) U.S. Cl.
CPC ..... *E21B 17/03* (2013.01); *E21B 17/0465* (2020.05)

(58) Field of Classification Search
CPC .... E21B 17/03; E21B 17/046; E21B 17/0465; E21B 17/05
See application file for complete search history.

(56) References Cited

U.S. PATENT DOCUMENTS 1,614,840 A * 1/1927 Winfields ..... E21B 29/007 166/55.6
3,228,487 A * 1/1966 Failing ..... E21B 19/086 173/140

(Continued)

FOREIGN PATENT DOCUMENTS

DE 19621849 A1 3/1997
DE 10023467 C1 9/2001

(Continued)

OTHER PUBLICATIONS

International Search Report dated Mar. 30, 2021; International Application No. PCT/EP2020/085611.

*Primary Examiner* — Shane Bomar
(74) *Attorney, Agent, or Firm* — Dinsmore & Shohl LLP

(57) ABSTRACT

A drill pipe connecting apparatus has radially extending locking openings to the drilling drive of a rig. An inner tube receives a free end of the drill pipe by the locking opening of the drill pipe. An outer tube at least partially encompasses the inner tube and connects to the drive. The inner tube has, at the drill pipe end, radially extending through-recesses for guiding/allowing passage of locking elements, radially slidingly movable in the through-recesses. External guide elements on the outer tube form control gates for adjusting the radial position of the locking elements between open/locking positions by relative rotation. A connecting device releasably connects the tubes in a rotationally fixed manner; positive-locking elements extend circumferentially around the inner face of the outer tube and on the outer face of the inner tube. These elements enter into positive-locking engagement or reach free-running position, depending upon the longitudinal tube position.

18 Claims, 11 Drawing Sheets

(56) References Cited

U.S. PATENT DOCUMENTS

| | | | | |
|---|---|---|---|---|
| 5,501,287 | A * | 3/1996 | Loeser | E21B 17/07 175/203 |
| 10,851,607 | B1 * | 12/2020 | Cavanagh | E21B 23/03 |
| 2004/0144571 | A1 * | 7/2004 | Boyd | E21B 17/05 166/242.7 |
| 2015/0330156 | A1 * | 11/2015 | Barannikow | E21B 17/05 166/242.6 |
| 2018/0223605 | A1 | 8/2018 | Pirazzini et al. | |
| 2018/0252269 | A1 * | 9/2018 | Schoknecht | E21B 17/06 |
| 2018/0363386 | A1 * | 12/2018 | Metzlaff | E21B 19/16 |
| 2019/0100970 | A1 * | 4/2019 | Mueller | E21B 19/16 |
| 2019/0195027 | A1 | 6/2019 | Samuel et al. | |

FOREIGN PATENT DOCUMENTS

| | | | |
|---|---|---|---|
| DE | 102004034703 | A1 | 2/2006 |
| DE | 102011108999 | A1 | 1/2013 |
| DE | 102013020761 | B4 | 1/2018 |
| EP | 1860275 | A1 | 11/2007 |
| EP | 3299572 | A1 | 3/2018 |

* cited by examiner

APPARATUS FOR CONNECTING A DRILL PIPE TO THE DRILLING DRIVE OF A DRILLING RIG, AND DRILLING ASSEMBLY FOR BOREHOLES COMPRISING SUCH AN APPARATUS

CROSS-REFERENCE TO RELATED APPLICATIONS

This application is the U.S. National Stage of PCT/EP2020/085611 filed on Dec. 10, 2020, which claims priority to German Patent Application 102019134109.4 filed on Dec. 12, 2019, and German Patent Application 202019106925.2 filed on Dec. 12, 2019 the entire content of both are incorporated herein by reference in their entirety.

FIELD OF THE INVENTION

The invention relates to an apparatus for connecting a drill pipe having radially extending locking openings to the drilling drive of a drilling rig.

The invention further relates to a drilling assembly for ground boring, comprising a drilling drive, at least one drill pipe having radially extending locking openings and a device for connecting the drill pipe to the drilling drive.

BACKGROUND OF THE INVENTION

The apparatus mentioned hereinbefore and the aforementioned drilling assembly are used in the creation of boreholes for civil engineering works. Such rotary drilling systems are utilized, in particular, in the creation of cased bores. In the production of bores of this type, a frequent tool change is necessary. The drilling tools are driven into the ground by means of drilling or pressing pipes. It is necessary to remove the drill pipes regularly out of the borehole to remove the excavated soil out of the drilling tool and to be able to store it beside the borehole. Subsequently, the drilling tool is to be introduced into the borehole again and accordingly to extend the already achieved drilling depth further by means of drill pipes. During the creation of such a borehole, it is therefore often necessary to connect the drilling drive of a drilling rig to the aforementioned drilling and/or pressing pipes and to release it again. Herein, it often occurs that a drill pipe is held freely hanging on the drilling drive. In this state, an unintended release can lead to severe harm to humans and equipment.

From the prior art, numerous methods and apparatuses are therefore known for connecting drill pipes of this type to the drilling drive of such a drilling rig.

From DE 10023467 C1, there is known a drilling apparatus in which the connection of the drilling drive to a free end of a drill pipe is locked by means of locking bolts. For this purpose, actuating rods by means of which the locking bolts can be actuated are arranged on the outer shell of a hollow cylindrical receiving device. A disadvantage lies therein that the actuating rods that are required are situated on the outer periphery of the receiving device and so in harsh field conditions are unprotected against dirt and damage. In addition, in the event of a faulty actuation of the locking bolts, the danger exists that, during decoupling without the prior attachment of securing means, a drilling and/or pressing pipe hanging on the receiving device can fall out.

SUMMARY OF THE INVENTION

A further locking apparatus for a rotary drilling system is disclosed by DE 10 2013 020 761 B4. Herein also, locking bolts that are each adjusted positionally displaceably by means of electric motors are used. The electric motors including the drive mechanism required for the displacement of the locking bolts are arranged on the outer periphery of the tool receptacle and are thus also subject to disruption and damage, as in the case of the above-mentioned rotary drilling system. In addition, for operating the electric motors, electrical control components are required, which are also fault-prone in harsh field conditions. DE 10 2013 020 761 B4 even proposes monitoring the position of the locking bolt by means of a dedicated position monitoring system and thus to check whether each locking bolt is actually in the desired locking position. This is not only complex from the system standpoint, but also does not reduce the risk that, in the event of a possible false operation, the free-hanging drilling or pressing pipe can fall down or fall over in the absence of external support.

It is therefore an object of the present invention to propose an apparatus of the aforementioned type that is as robust as possible against disturbance and simultaneously reliably prevents the risk of accidental loosening of the drilling or pressing pipe from the drilling drive. It is a further object of the present invention to propose a corresponding drilling assembly for ground boring operations.

The object is achieved with the aforementioned apparatus for connecting a drill pipe which has radially extending locking openings to the drilling drive of a drilling rig, comprising an inner tube designed to receive a free end of the drill pipe by means of the locking opening of the drill pipe, an outer tube which at least partially encompasses the inner tube and is designed for connecting to the drilling drive, the inner tube having, at its end that connects to the drill pipe, radially extending through-recesses designed for guiding and allowing the passage of locking elements, the locking elements being arranged radially slidingly movable in the through-recesses, guide elements arranged externally on the outer tube, each forming a control gate for adjusting the radial position of the locking elements between an open position and a locking position by rotation of the inner tube relative to the outer tube, and a connecting device which is designed to connect the outer tube to the inner tube releasably in a rotationally fixed manner in that positive-locking elements are arranged extending at least partially round the circumference on the inner wall face of the outer tube and on the outer wall face of the inner tube, the positive-locking elements being designed to enter into positive-locking engagement with one another, thereby forming the rotationally fixed connections, or to reach the free-running position out of engagement, depending upon the longitudinal axial position between the outer tube and the inner tube relative to one another.

The apparatus according to the invention is particularly robust in relation to dirt and/or the effect of external mechanical forces. Due to the purely mechanical construction, the apparatus according to the invention comprises no sensitive components such as electrical or hydraulic actuating motors, and also no electronic assemblies. In addition, the positive-locking elements are arranged between the outer tube and the inner tube and thus are accordingly protected against external mechanical effects. A further advantage lies therein that by means of the apparatus according to the invention, the connection of a drill pipe to the drilling drive can be carried out solely at the drilling drive and by the machine operator. Thus, a rotationally fixed coupling of the drilling drive to the drill pipe only takes place if, by means of the drilling drive, a corresponding tensile or pressure force is exerted on the drill pipe and immediately, through rotation of the inner tube relative to the outer tube, by means of the guide elements, a locking with the drill pipe takes place by means of the locking elements. The connection between the drill pipe and the drilling drive is then only possible again when the respective longitudinal axial positions between the outer tube and the inner tube relative to one another are set by the operator of the drilling rig such that the positive-locking elements are in the free-running position. It is only possible for the free-running position to be reached when no or at least substantially no tensile or pressure force is exerted in the longitudinal axial direction from the drilling drive onto the drill pipe. This offers the advantage that a decoupling and/or releasing of the drill pipe from the drilling drive by means of the apparatus according to the invention is possible only if no appreciable force acts in the longitudinal axial direction between the drill pipe and the drilling drive via the apparatus according to the invention. It is therefore practically precluded that a drill pipe hanging on the drilling drive via the apparatus according to the invention can be released unintentionally, since due to the weight force of the drill pipe acting upon the apparatus according to the invention, the positive-locking elements always remain in positive-locking engagement and cannot reach the free-running position.

A suitable embodiment of the invention is characterized in that the positive-locking elements are a toothed rim pair with tooth profiles facing toward one another, spaced apart from one another in the longitudinal axial direction and a double toothed rim, each having a tooth profile facing the tooth profiles of the toothed rim pair. The use of the toothed rim pair and the double toothed rim as the positive-locking elements offers the advantage that both on application of pressure force and of tensile force, a rotationally fixed connection is created between the outer tube and the inner tube, so that in this state, a relative rotation between the outer tube and the inner tube is precluded due to the rotationally fixed coupling. This further offers the advantage that the locking elements situated in a locking position always remain in their position and in this way, a secure coupling with the drill pipe is guaranteed.

A preferred development of the invention is characterised in that the toothed rim pair is arranged on the outer wall face of the inner tube and the double toothed rim is arranged on the inner wall face of the outer tube. By way of the mutual arrangement of the toothed rim pair and the double toothed rim, respectively at the outer wall face of the inner tube and at the inner wall face of the outer tube, the precondition exists for a rotationally fixed coupling of the outer and the inner tube, provided both are in positive-locking engagement.

According to a further preferred development of the invention, the double toothed rim is arranged on the outer wall face of the inner tube and the toothed rim pair is arranged on the inner wall face of the outer tube. The aforementioned embodiment regarding the arrangement of the double toothed rim and the toothed rim pair represents a further advantageous embodiment of the invention. It is thus optionally possible to arrange the toothed rim pair on the outer wall face of the inner tube or on the inner wall face of the outer tube. In this case, the double toothed rim is then to be arranged on the relevant other tube.

A further suitable embodiment of the invention is characterised in that the tooth flank angle of the tooth profile is less than 7 degrees. The selection of the stated tooth flank angle as smaller than 7 degrees offers the advantage that on transmission of the torque between the inner and outer tubes, no propulsion takes place between the tooth profiles in the longitudinal axial direction.

According to a further preferred embodiment, the circumferential surface of the outer tube has recesses in the region of the guide elements. The aforementioned recesses in the circumferential surface of the outer tube give the guide elements the corresponding space to be able to pivot sufficiently far relative to one another on rotation of the inner tube and the outer tube.

A further suitable embodiment of the invention is characterised in that the locking elements are biased by means of spring elements such that they abut the guide elements under spring tension. Advantageously, it is thereby achieved that the locking elements are automatically moved radially outwardly on reaching the free-running position, so that they uncover the locking opening of the drill pipe and the coupling with the drill pipe is thereby automatically released. As described above, this automatic uncovering of the locking of the drill pipe only takes place when the positive-locking elements are in the free-running position so that an unintentional releasing of the drill pipe from the apparatus according to the invention is prevented in any event.

According to a further preferred embodiment of the invention, each of the guide elements has a gliding surface on which the head side of the locking element is slidingly guided. The gliding surfaces of the guide element each form a sliding guide with the head sides of the locking elements which is particularly robust against dirt or damage by external mechanical effects.

A preferred development of the invention is characterised in that the spacing between the outer wall face of the inner tube and a middle region of the gliding surface corresponds at least substantially to the length of one of the locking elements. By this means, it is ensured that in the open position, the locking elements are guided out of the locking openings of the drill pipe at least so far that said drill pipe becomes completely free from the apparatus according to the invention.

According to a further preferred embodiment of the invention, the gliding surface is inclined, starting from the middle region, on both sides toward the inner tube. Differently expressed, the gliding surface is configured such that it has the greatest possible spacing from the outer tube in the aforementioned middle region, while at both sides the spacing between the gliding surface and the outer tube is less. Thus, the gliding surface forms a control surface which, on rotation of the inner tube relative to the outer tube in both clockwise and anticlockwise directions, always leads to a movement of the locking elements inwardly in the radial direction. In this way, the functionality of the locking by relative rotation of the inner tube and the outer tube is brought about.

A further suitable embodiment of the invention is characterised in that each of the guide elements comprises lateral holding elements between which the gliding surface is arranged. The holding elements therein fulfil a double function. On the one hand, they form spacing elements in order to arrange the gliding surface with the required spacing from the circumferential surface of the outer tube. On the other hand, they form countersupport elements for the locking elements to limit the maximum possible rotation of the outer and inner tube relative to one another.

According to a further preferred embodiment of the invention, each locking element comprises at least one head part and at least one locking part. Differently expressed, the locking element is configured in two parts. With this two-part construction, the individual parts can be produced separately. Such separate production processes increase the flexibility in production, offer more possibilities in the design and in the application of the locking elements, in particular, it is therefore possible to exchange only the components that are subject to a high mechanical load and therefore increased wear. Thus, the forces acting during the locking process from the circumferential surface of the outer tube on the locking part are a reason to expect an increased loading of the locking part in relation to the head part and thereby more rapid wearing of the locking part. The two-part construction of the locking element enables a more targeted exchange and also an easier installation and removal of wearing parts. The replacement of the whole locking part is avoided and thereby material and costs therefor are spared. This leads to lower construction and operating costs.

A further suitable embodiment of the invention is characterized in that the sides of the head part and the locking part which are inclined toward one another are configured and adapted as coupling sides such that the head part and the locking part are adapted to be releasably connectable to one another in a positive and/or non-positive locking manner. In this way, the head part and the locking part can be joined together in a particularly simple manner and, if needed, separated from one another again.

Preferably, the head part and the locking part each have sides which permit a coupling thereof to one another. In this way, they can be joined together such that the firmness and durability thereof is equal to a locking element constructed in one part. At the same time, the connection of the head part and the locking part is releasable again at any time in order to ensure a targeted exchange of defective or worn parts and to ensure a simple installation, removal and re-installation of the head part and the locking part.

According to a further preferred embodiment of the invention, the coupling sides in the connected state of the head part are in releasable engagement with the locking part.

The releasable engagement on the one hand increases the contact area of the head and the locking part, so that the positive and/or non-positive locking engagement and therefore the cohesion of the individual parts of the locking element is reinforced and, on the other hand, the engagement is releasably constructed, so that the constituents can be separated again without destruction. A complete exchange which would otherwise be required can thereby be avoided.

A further suitable embodiment of the invention is characterised in that at least one securing element is designed and configured for releasable locking in place of the head part with the locking part. The securing elements ensure the locking in place of the head part and the locking part and thus bring about the firm holding of the head part and the locking part to one another. In particular, the securing element is designed to prevent an unintentional release of the connection between the head part and the locking part. Additionally, they can be released again and therefore ensure the previously described flexibility of the installation and removal and the exchange and repair of the locking element or its constituents.

According to a further preferred embodiment, the securing element is arranged in a plane perpendicular to the rotation plane of the drill pipe. The securing element therefore forms a blocking element which, with forces acting in the rotation plane, remains in its position.

Since the securing element is arranged such that it does not lie in the rotation plane, force components that act in the rotation plane do not affect the securing element such that it could become released. In this way, a reliable locking in place is always achieved, even under load.

According to a further preferred embodiment of the invention, the locking part has a greater surface hardness as compared with the head part. By reason of the high loading due to the sliding contact of the locking part with the circumference of the outer tube, a higher surface hardness in this component as compared with the head part is advantageous for the wear resistance, longevity and reliability of the locking part. Due to the two-part nature of the locking element, the head part which is exposed to lower mechanical wear can be constructed of a material of lower firmness. In this way, the manufacturing and replacement costs can be significantly reduced, since only one part is to be constructed of a material of higher surface hardness.

The invention further relates to a drilling assembly for ground boring, comprising a drilling drive, at least one drill pipe having radially extending locking openings and an apparatus for connecting the drill pipe to the drilling drive. All the advantages and preferred features of the apparatus according to the invention apply in the same way for the drilling assembly according to the invention, so that at this point, for the avoidance of repetition, including in relation to the drilling assembly according to the invention, reference is made to these.

BRIEF DESCRIPTION OF THE DRAWINGS

Further preferred and/or suitable features and embodiments of the invention are disclosed herein. Particularly preferred embodiments will now be described in greater detail making reference to the accompanying drawings, in which.

and

Figure 11:
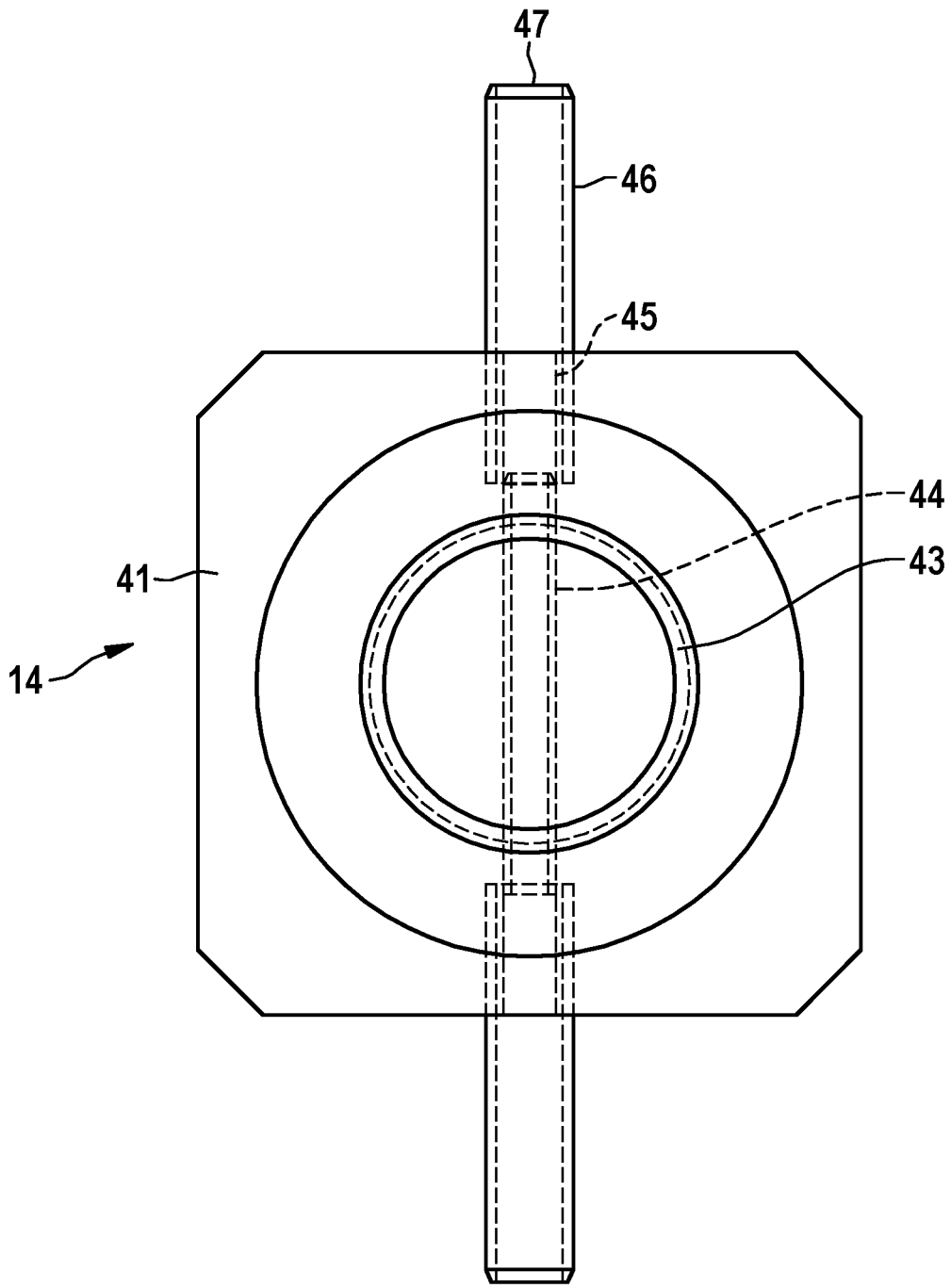

FIG. 11 shows a perspective view of the locking element with the direction of view toward the locking part.

DETAILED DESCRIPTION OF THE INVENTION

The drilling apparatuses mentioned hereinbefore are well known from the prior art, so that a detailed representation thereof in the drawings is dispensed with as far as possible. The apparatus according to the invention as shown in the drawings serves on the one hand to be connected to the drilling drive of a drilling rig and on the other hand to create a connection to a drill pipe 39—shown in the drawings only in FIG. 7.

Figure 1:
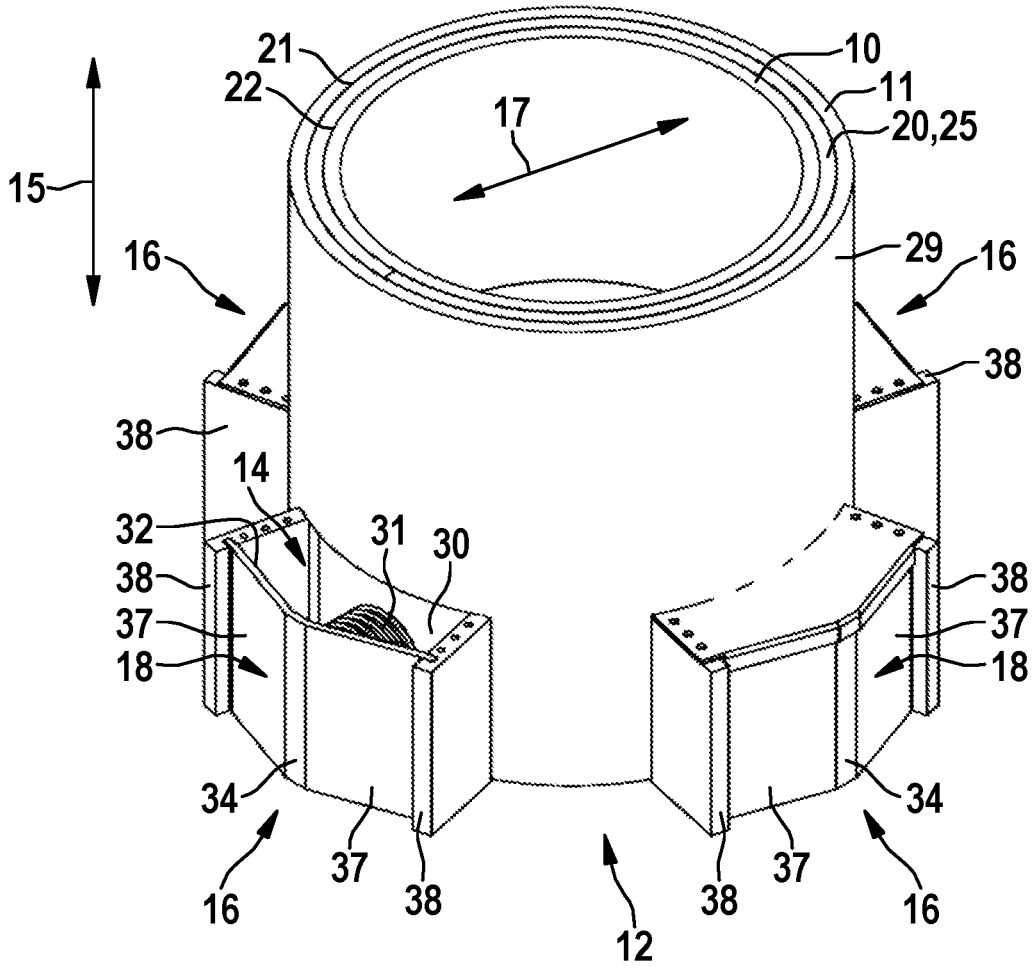
FIG. 1 shows a perspective view of the apparatus according to the invention in an unlocking state.

FIG. 1 shows a perspective view of the apparatus according to the invention in the unlocking state. The apparatus according to the invention comprises an inner tube 10 which is configured and adapted to receive with its locking opening 40 a free end of the drill pipe 39. The apparatus according to the invention further comprises an outer tube 11 which partially or completely encompasses the inner tube 10 and is also designed for connection to the drilling drive (not shown in the drawings).

Figure 2:
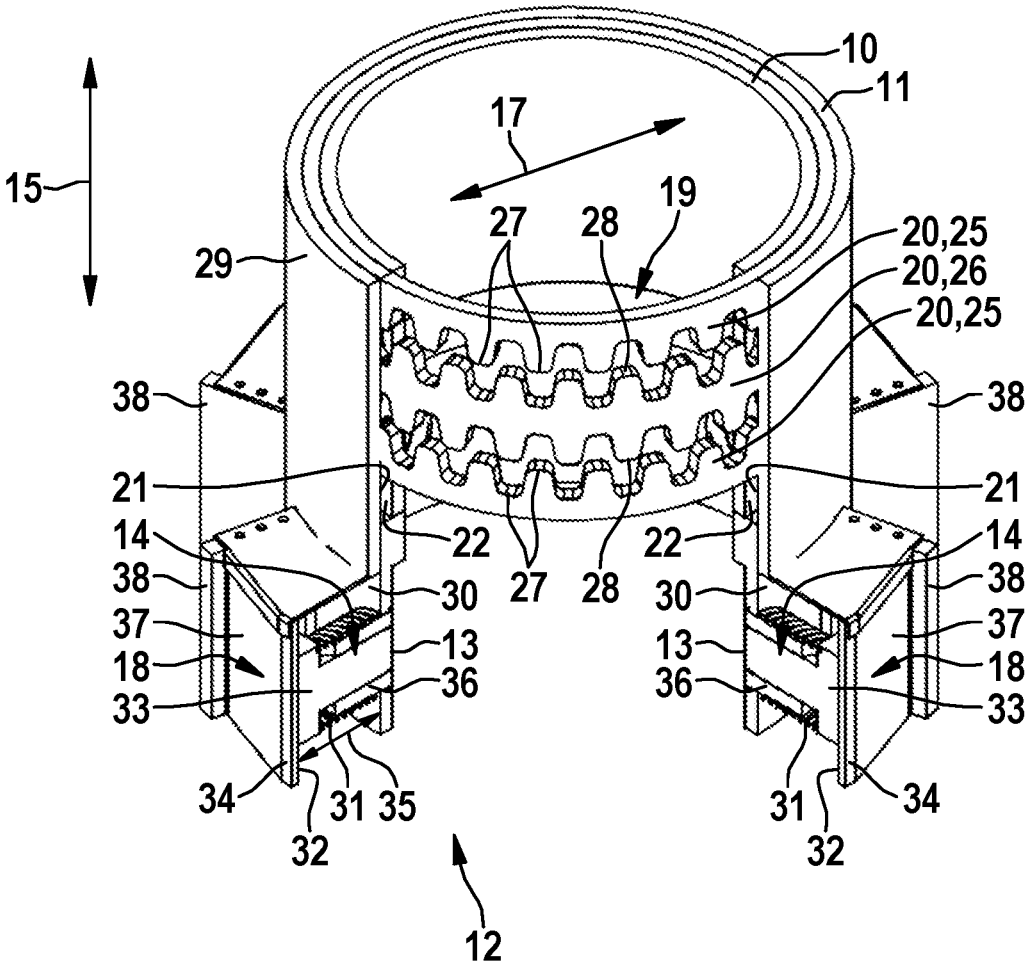
FIG. 2 shows a cut-away view of the apparatus shown in FIG. 1.
Figure 3:
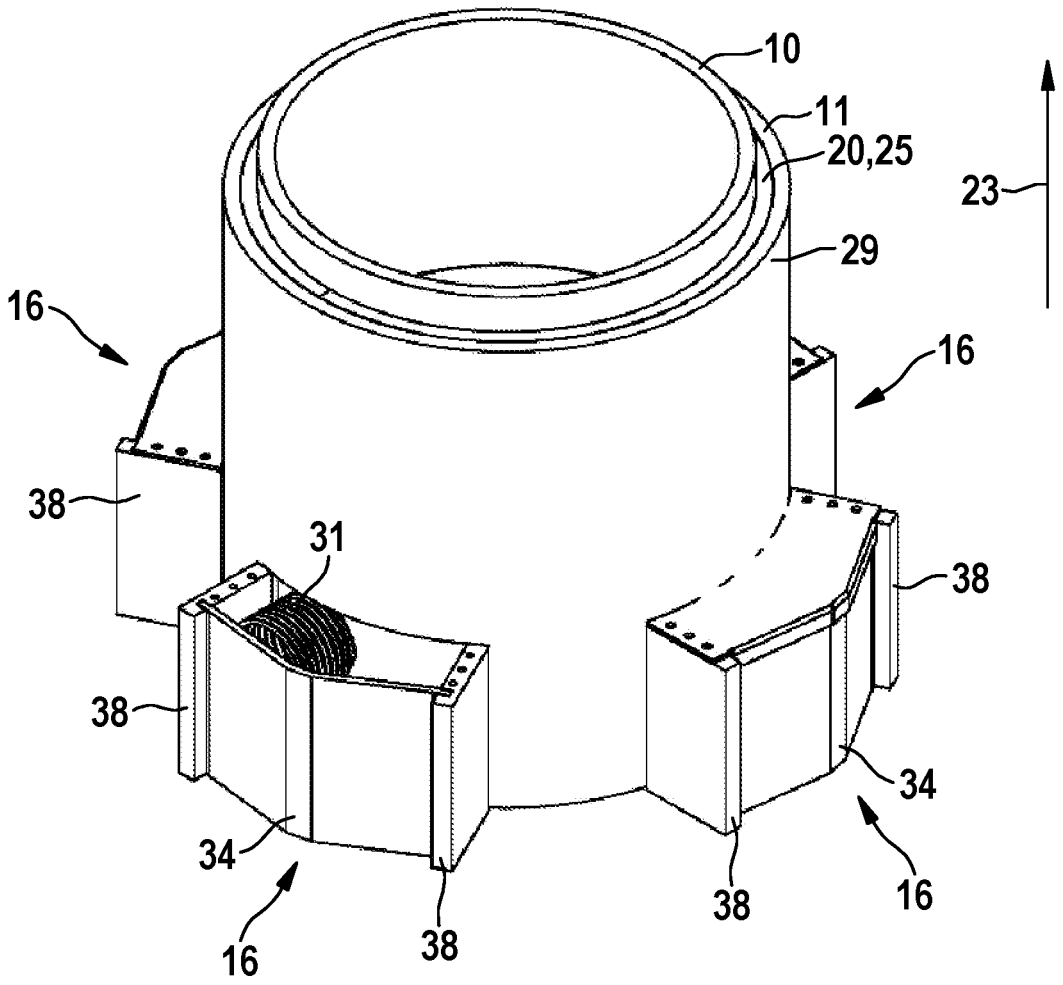
FIG. 3 shows a perspective view of the apparatus according to the invention in the locking position under tensile loading.

As shown in FIG. 2, the inner tube 10 has, at its end 12 toward the drill connection, radially extending through-recesses 13. The through-recesses 13 are configured and adapted to guide locking elements 14 slidingly movably in the radial direction 17. In other words, the locking elements 14 are arranged radially slidingly movable in the through-recesses 13. In this way, the locking elements 14 can be displaced radially inwardly to engage in the radially extending locking openings 40 (shown in FIG. 7) of the respective drill pipe 39 and so to form with said bore pipe a connection that is rotationally fixed and simultaneously loadable in the axial direction 15.

As shown in FIGS. 1 and 2, the apparatus according to the invention has guide elements 16 further externally on the outer tube 11. As mentioned above, the locking elements 14 are arranged radially slidingly movable in the through-recesses 13, that is, in the radial direction 17. The guide elements 16 each have control gates 18 which are configured for adjusting the radial position of the locking elements 14 between an open position and a locking position (shown in FIGS. 3, 4, 5, 6 and 7). The control gates 18 are adapted so that the locking elements 14 optionally reach the open or the locking position through rotation of the inner tube 10 relative to the outer tube 11. In order to reach the locking position, the locking elements 14 are moved inwardly by means of the control gate 18 in the radial direction 17, as show in FIGS. 3 to 7. In order to reach the open position, the control gate 18 enables a movement of the locking elements 14 outwardly in the radial direction 17, as show in FIGS. 1 and 2.

In the cut-away view in FIG. 2, there is a clear view of a portion of the connecting device 19 which in FIG. 1 is shown entirely covered by the outer tube 11. The connecting device 19 is preferably configured to connect the outer tube 11 and the inner tube 10 to be both rotationally fixed and also releasable.

For this purpose, positive-locking elements 20 are provided, wherein on the inner wall face 21 of the outer tube 11 and on the outer wall face 22 of the inner tube 10, the aforementioned positive-locking elements 20 are arranged extending at least partially round the circumference. The inner tube 10 and the outer tube 11 are configured to be displaceable relative to one another in the axial direction 15—mechanically limited only by the positive-locking elements 20. Otherwise expressed, the respective longitudinal axial positions between the outer tube 11 and the inner tube 10 relative to one another can be changed. Otherwise expressed, the outer tube 11 and the inner tube 10 can be displaced relative to one another in their longitudinal axial position.

In the unlocked state shown in FIGS. 1 and 2, the positive-locking elements 20 are in the free-running position, and so they are out of engagement with one another. In this case, there is no rotationally fixed connection between the positive-locking elements 20, so that the inner tube 10 and the outer tube 11 are not connected to one another in a rotationally fixed manner.

Figure 4:
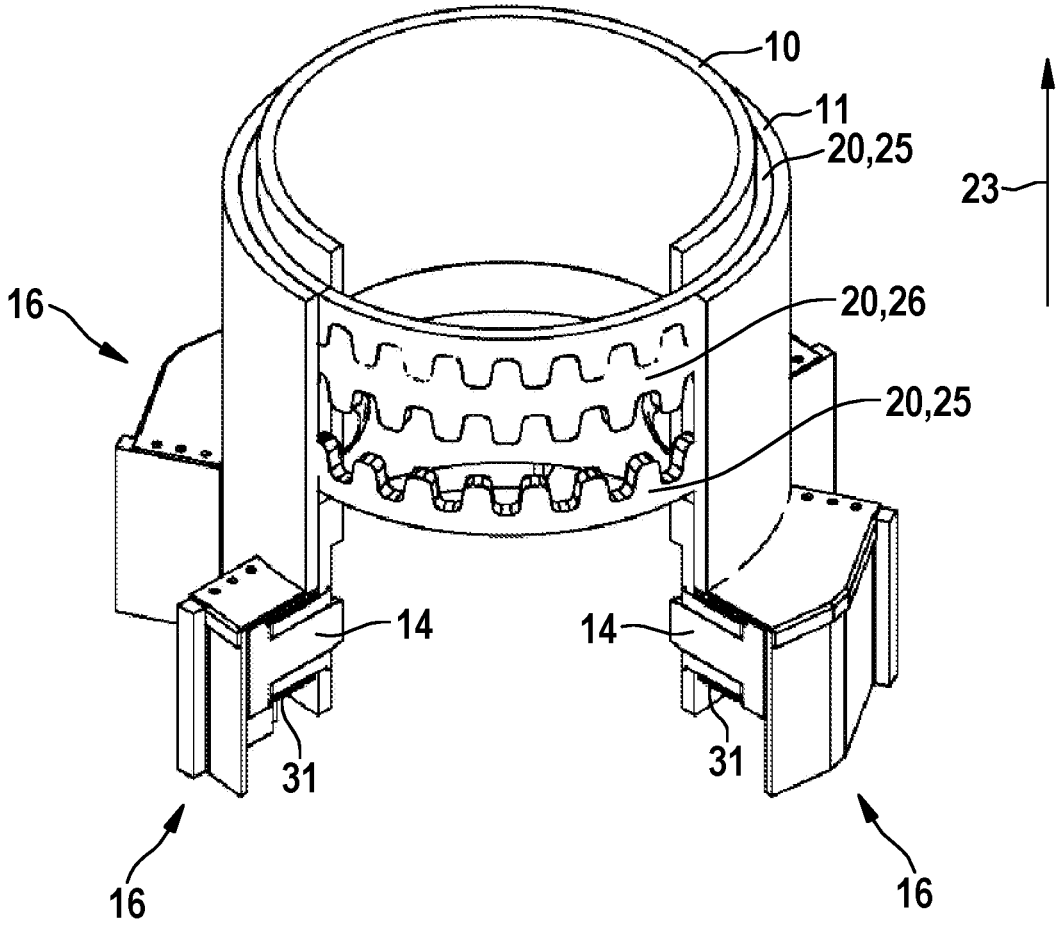
FIG. 4 shows a cut-away view of the apparatus shown in FIG. 3.
Figure 5:
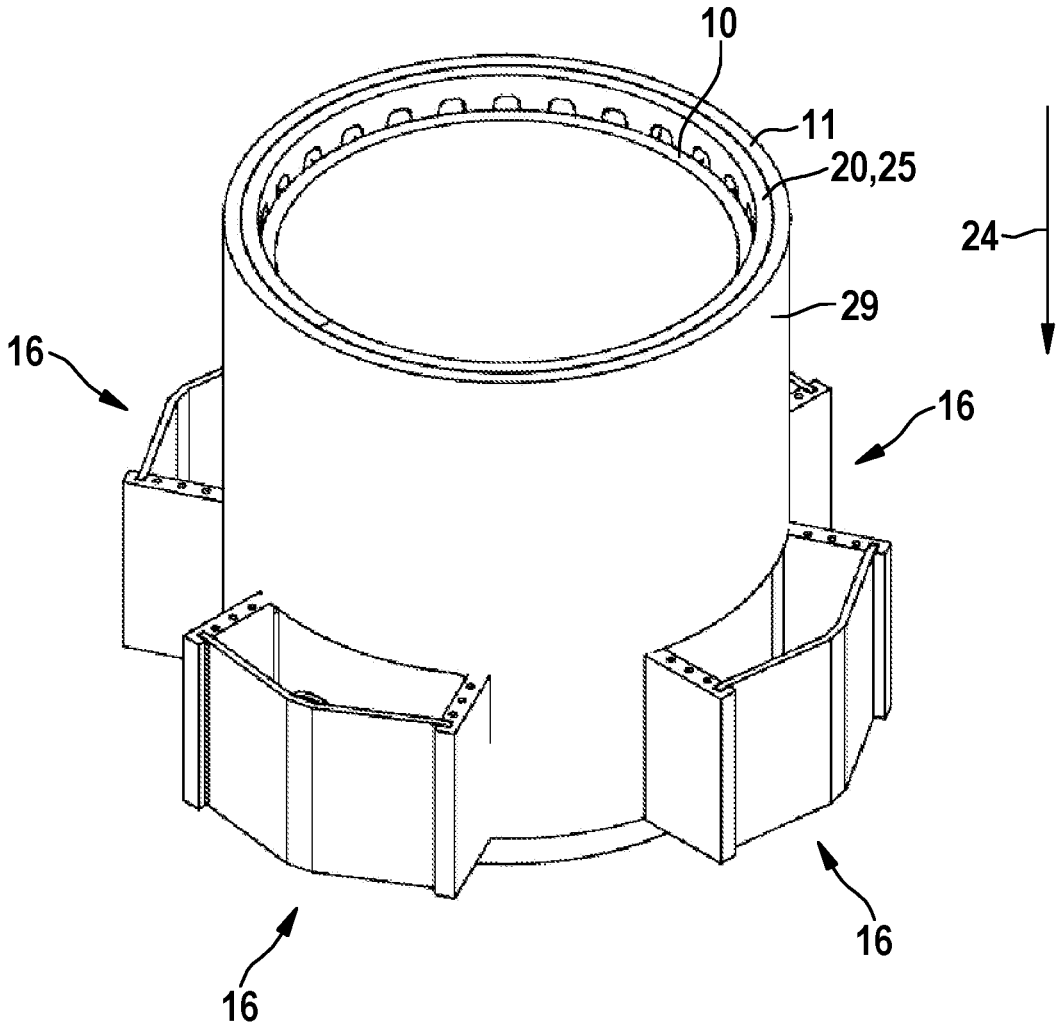
FIG. 5 shows a perspective view of the apparatus according to the invention in the locking position under pressure loading.
Figure 6:
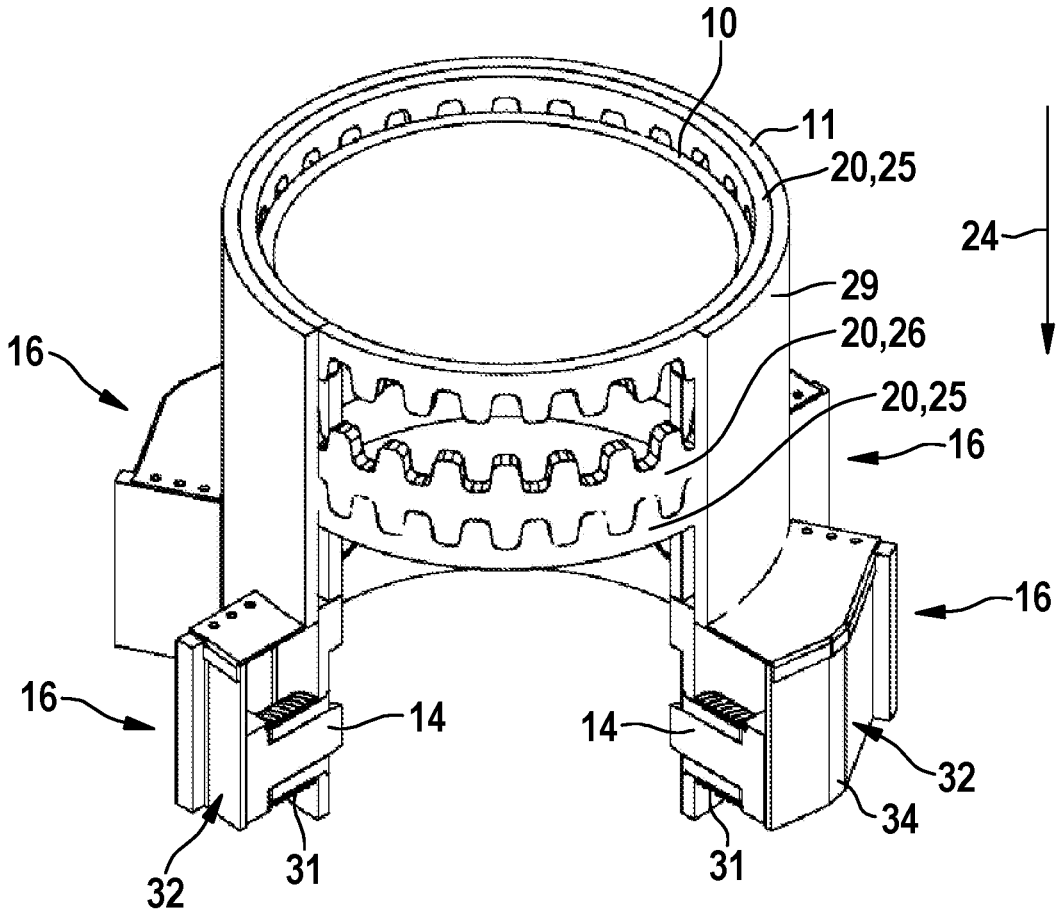
FIG. 6 shows a cut-away view of the apparatus shown in FIG. 5.

The positive-locking elements 20 enter into positive-locking engagement with one another if—as shown in FIG. 4—the inner tube 10 is displaced relative to the outer tube 11 in the tensile direction 23. This state arises, for example, if a tensile force is exerted on the drill pipe 39 by the drilling drive (not shown in the drawings). As FIG. 4 shows, the two upper positive-locking elements 20 enter into positive-locking engagement with one another and thereby form a rotationally fixed connection between the inner tube 10 and the outer tube 11.

In a similar manner, the two lower positive-locking elements 20 enter into interlocking engagement with one another if the inner tube 10 is displaced relative to the outer tube 11 in the pressure direction 24. This state arises, for example, if a pressure force is exerted on the drill pipe 39.

It is apparent that the positive-locking elements 20 are designed to enter into positive-locking engagement with one another, depending upon the position of the inner tube 10 relative to the outer tube 11 in the axial direction 15, that is, either on a displacement of the inner tube 10 relative to the outer tube 11 in the tensile direction 23 or in the pressure direction 24. Thus, in each of the longitudinal axial positions, a rotationally fixed connection is brought about between the inner tube 10 and the outer tube 11. A decoupling of this rotationally fixed connection between the inner tube 10 and the outer tube 11 takes place when the positive-locking elements 20 are in the free-running position.

Preferably, the positive-locking elements 20—as shown in the drawings—are designed as a toothed rim pair 25 and a double toothed rim 26. The toothed rim pair 25 has tooth profiles 27 spaced apart from one another in the longitudinal axial direction and facing one another. Arranged between these toothed rim profiles 27 is the double toothed rim 26 with its tooth profile 28 which corresponds to each of the tooth profiles 27 of the toothed rim pair 25. Further preferably, the toothed rim profiles 27 and the toothed rim profile 28 are configured corresponding with regard to their geometry such that the positive-locking engagement described above takes place in the middle position between the inner tube 10 and the outer tube 11.

Further preferably—as shown in the drawings—the toothed rim pairs 25 are arranged on the outer wall face 22 of the inner tube 10 and the double toothed rim 26 is arranged on the inner wall face 21 of the outer tube 11. Otherwise expressed, the toothed rim pair 25 forms one structural unit with the inner tube 10, whilst the double toothed rim 26 forms one such unit with the outer tube 11. In a further advantageous embodiment—not shown in the drawings—of the present invention, the double toothed rim 26 is arranged on the outer wall face 22 of the inner tube 10 and the toothed rim pair 25 is arranged on the inner wall face 21 of the outer tube 11.

Preferably, the tooth flank angle of the tooth profile is less than 7 degrees. This means that the respective tooth flank angle of the toothed rim profile 27 and of the toothed rim profile 28 do not exceed the aforementioned angular quantity. Through the selection of the specified tooth flank angle, it is always ensured that a torque that acts from the inner tube 10 to the outer tube 11 and vice versa does not lead to any generation of pressure or tensile forces in the axial direction 15.

The circumferential surface 29 of the outer tube 11 has recesses 30 in the region of the guide elements 16, so that in the region of these recesses 30, the locking elements 14 enter through the outer tube 11. The size of the recesses 30 also determines the maximum pivot angle through which the inner tube 10 can be rotated relative to the outer tube 11 before a further rotation of the two tubes relative to one another mechanically blocks a further relative pivoting through a collision of the connecting elements 14 with the circumferential surface 29 of the outer tube 11 to both sides.

Further preferably, the locking elements 14 are spring-biased by means of spring elements 31. The spring-biasing thereby generated serves to press the locking elements 14 against the guide element 16 and automatically to force said guide element outwardly in the radial direction 17.

Preferably, each of the guide elements 16 comprises a gliding surface 32. The head side 33 of the locking elements 14 is slidingly guided on this gliding surface 32. The gliding surface 32 thus causes the movement of the locking elements 14 in the radial direction 17 dependent upon its radial distance.

Preferably, the spacing 35 between the outer wall face 22 of the inner tube 10 and a middle region 34 of the gliding surface 32 is selected so that it corresponds to the length of one of the locking elements 14 and/or substantially to the length of one of the locking elements 14. The spacing 35 is thus optimally configured so that the locking elements 14 in the unlocked position—shown in FIG. 2—are positioned just far enough outwardly in the radial direction 17 so that they no longer protrude on the inside of the inner tube 10 from the through-recess 13. Advantageously, the locking elements 14 are not guided only by the through-recesses 13, but are also mounted slidingly movable in corresponding guide sleeves 36.

According to a further preferred embodiment of the invention, each gliding surface 32 is inclined on both sides 37, starting from the middle region 34, tilted toward the inner tube 10. Otherwise expressed, the gliding surfaces 32 are configured such that they are furthest removed from the inner tube 10 in their middle region 34 by the spacing 35 and are inclined to both their sides 37 toward the inner tube 10, that is, they have a smaller spacing from the inner tube 10 there than the radial spacing 35.

Preferably, each of the guide elements 16 comprises lateral holding elements 38 between which the gliding surface 32 is arranged. The holding elements 38 fulfil a double function, that is, on the one hand they serve as a holder for the gliding surface 32 and on the other hand form a countersupport for the locking elements 14 for delimiting the maximum relative rotatability between the inner tube 10 and the outer tube 11.

Figure 8:
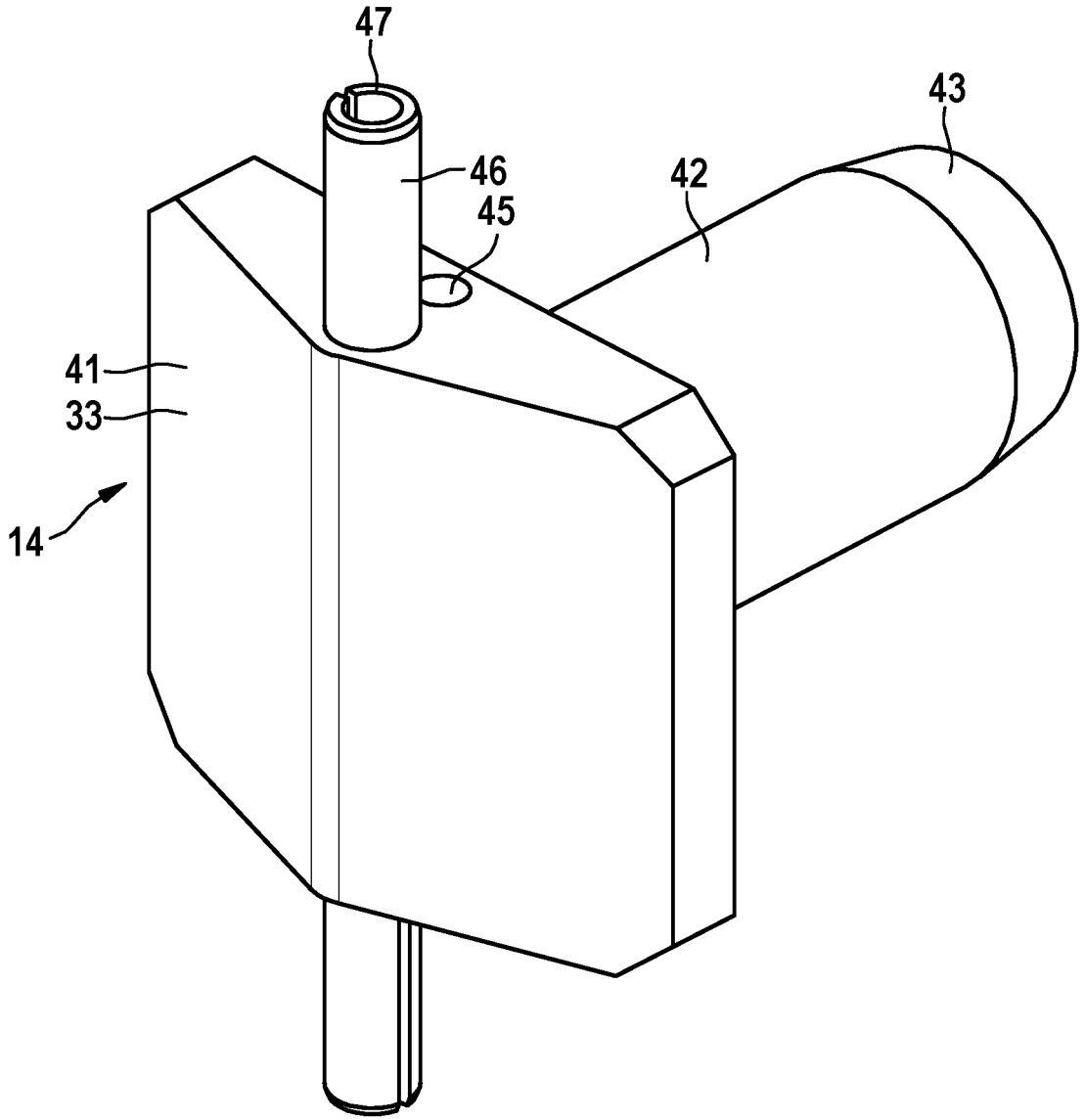
FIG. 8 shows a perspective view of the locking element according to the invention.
Figure 9:
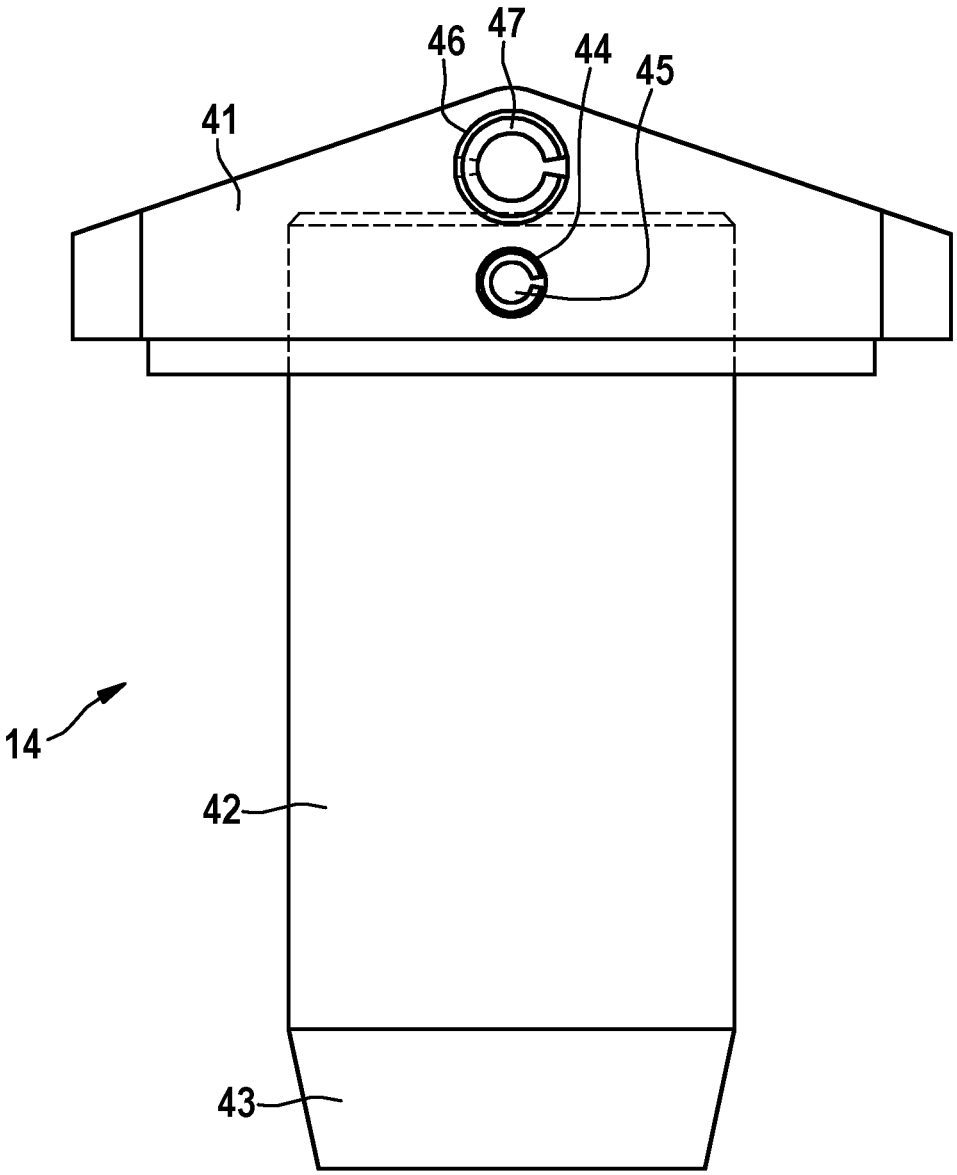
FIG. 9 shows a perspective view of the locking element shown in FIG. 8 in plan view.

FIG. 8 shows a perspective view of the locking element 14 according to the invention. The locking element 14 comprises a head part 41 and a locking part 42 which is preferably designed to be cylindrical. The head part 41 comprises the head side 33 of the locking element 14 and thus forms a head side 33 facing away from the locking part 42 and interacting with the gliding surface 32. The free end of the locking part 42 has a locking head 43 which, as the drawing shows, is conically formed and/or chamfered.

The sides—not explicitly shown in the drawings—of the head part 41 and the locking part 42 that face toward one another are configured and adapted as coupling sides such that the head part 41 and the locking part 42 are configured to be releasably connectable to one another in a positive and/or non-positive locking manner. For example, for this purpose, in the side of the head part 41 facing the locking part 42, a recess is provided into which the side of the locking part 42 facing the head part 41 engages exactly fittingly or with a slight oversize to achieve a tight seating to form a compound part. The coupling sides can be released from one another again if needed, and therefore engage releasably with one another.

As shown in FIG. 8, the head part 41 has a bore 45 which is configured and adapted for receiving a securing element 44. The securing element 44 is preferably configured as a securing pin, for example, in the form of a split hollow cylinder. Preferably, the diameter of the securing pin is selected to be slightly greater than that of the bore 45, so that the securing pin is automatically held in the bore 45 with tight seating, but for removal of the securing element 44, is designed able to be driven out. Optionally, the locking part 42 is configured tapering toward the head part 41.

Figure 10:
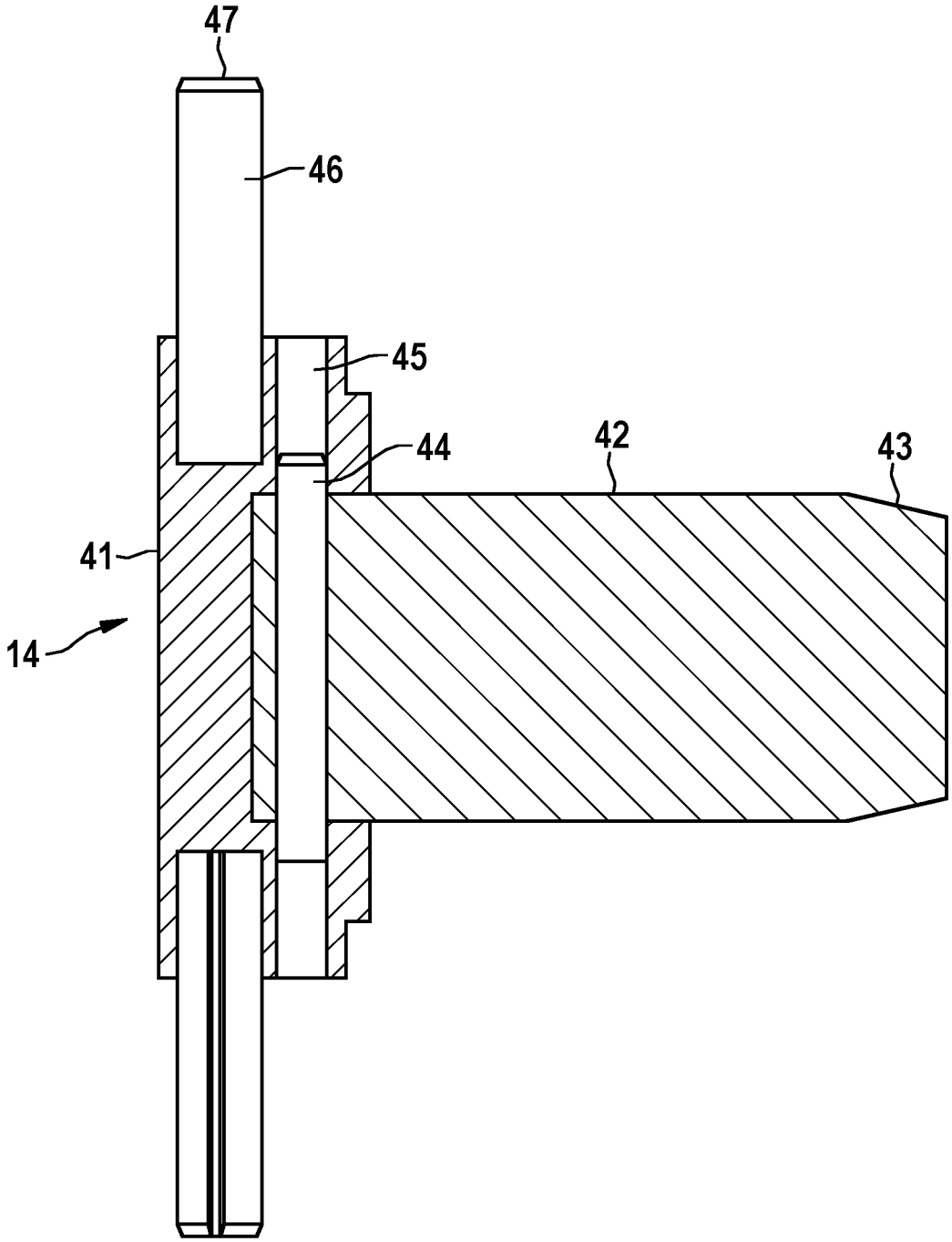
FIG. 10 shows a sectional view of the locking element shown in FIGS. 8 and 9.

As FIG. 10 shows, the locking part 42 also has a transverse bore—not shown in detail in the drawing—which is arranged such that, in the connected state of the head part 41 and the locking part 42, as shown, said transverse bore aligns with the bore 45. In this way, the bore 45 together with the transverse bore of the locking part 42 forms a through receiving space for the securing element 44. In this way, the securing element 44 introduced into the through receiving space locks the locking part 42 in place with the head part 41 against unintended release. It is not necessarily required that the transverse bore of the locking part 42 is configured as a through recess. Alternatively, two countersink bores can be provided in extension of the bore 45. For locking in place, one of the securing elements 44 is then introduced into each of the countersink bores.

FIG. 11 shows a perspective view of the locking element 14 from the front in a perspective view toward the locking head 43. Optionally, the head part 41 has recesses on oppositely arranged end faces to receive a sighting aid 46. Preferably, the recesses are designed as countersink bores. The sighting aids 46 serve a machine operator for easy recognition of the respective positions of the locking element 14. Further preferably, the sighting aids 46 are designed similarly to the securing elements 44.

Figure 7:
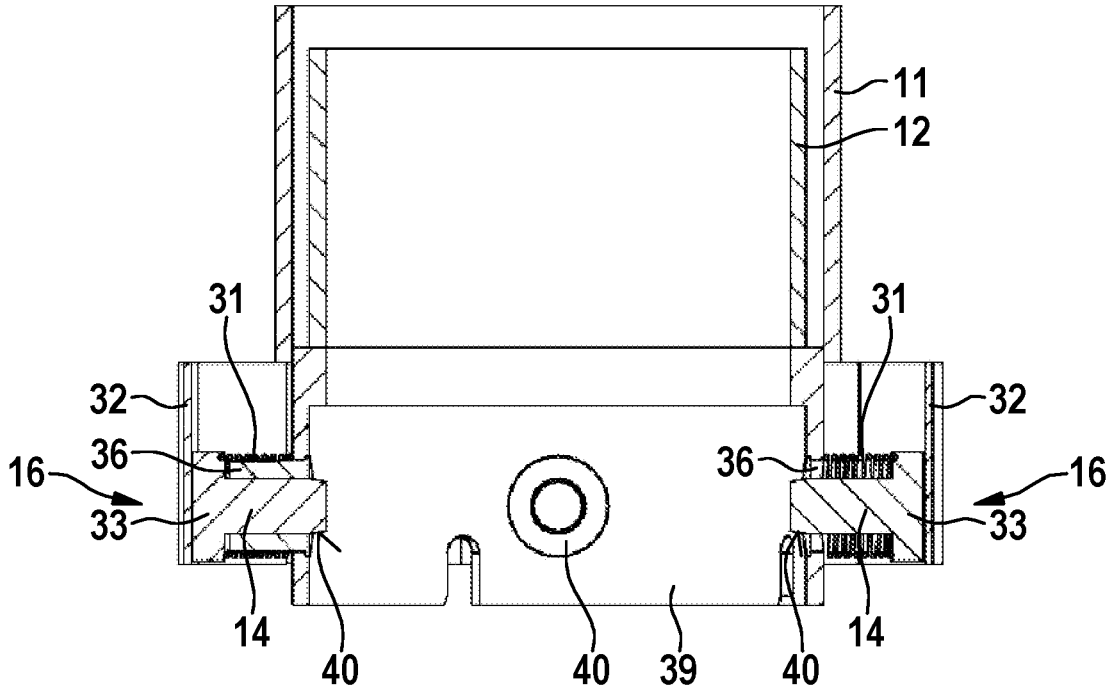
FIG. 7 shows a sectional view of the apparatus shown in FIGS. 5 and 6.

The invention also relates to a drilling assembly—not shown in detail in the drawings—for ground boring operations, which comprises a drilling drive and at least one drill pipe 39—shown in FIG. 7—with radially extending locking openings 40. This drilling assembly also has the apparatus according to the invention described above for connecting the drill pipe 39 to the drilling drive, having the aforementioned features. The advantages and functions of the apparatus according to the invention for connecting the drill pipe 39 to the drilling drive have been set out in detail above and apply in the same way for the drilling assembly according to the invention.

The invention claimed is:

1. An apparatus for connecting a drill pipe having radially extending locking openings to a drilling drive of a drilling rig, comprising:

an inner tube which is designed to receive with its locking opening a free end of the drill pipe;

an outer tube which at least partially encompasses the inner tube and is designed for connecting to the drilling drive, the inner tube having, at its end that connects to the drill pipe, radially extending through-recesses designed for guiding and allowing the passage of locking elements, the locking elements being arranged radially slidingly movable in the through-recesses;

guide elements arranged externally on the outer tube, each forming a control gate for adjusting the radial position of the locking elements between an open position and a locking position by rotation of inner tube relative to the outer tube; and a connecting device which is adapted to connect the outer tube to the inner tube releasably in a rotationally fixed manner in that positive-locking elements are arranged extending at least partially round the circumference on the inner wall face of the outer tube and on the outer wall face of the inner tube, the positive-locking elements being designed to enter into positive-locking engagement with one another, thereby forming the rotationally fixed connections, or to reach a free-running position out of engagement, depending upon a longitudinal axial position between the outer tube and the inner tube relative to one another.

2. The apparatus according to claim 1, wherein the positive-locking elements are a toothed rim pair with tooth profiles facing toward one another, spaced apart from one another in the longitudinal axial direction, and a double toothed rim, each having a tooth profile facing the tooth profiles of the toothed rim pair.

3. The apparatus according to claim 2, wherein the toothed rim pair is arranged on the outer wall face of the inner tube and the double toothed rim is arranged on the inner wall face of the outer tube.

4. The apparatus according to claim 2, wherein the double toothed rim is arranged on the outer wall face of the inner tube and the toothed rim pair is arranged on the inner wall face of the outer tube.

5. The apparatus according to claim 2, wherein a tooth flank angle of the tooth profile is less than 7 degrees.

6. The apparatus according to claim 1, wherein a circumferential surface of the outer tube has recesses in a region of the guide elements.

7. The apparatus according to claim 1, wherein the locking elements are biased by spring elements such that the locking elements abut the guide elements under spring pretension.

8. The apparatus according to claim 1, wherein each of the guide elements has a gliding surface on which a head side of the locking element is slidingly guided.

9. The apparatus according to claim 8, wherein a spacing between the outer wall face of the inner tube and a middle region of the gliding surface corresponds at least substantially to a length of one of the locking elements.

10. The apparatus according to claim 9, wherein the gliding surface is inclined on both sides, starting from the middle region, toward the inner tube.

11. The apparatus according to claim 10, wherein each of the guide elements comprises lateral holding elements between which the gliding surface is arranged.

12. The apparatus according to claim 1, wherein the locking element comprises at least one head part and at least one locking part.

13. The apparatus according to claim 12, wherein sides of the head part and of the locking part are inclined toward one another and are configured and adapted as coupling sides such that the head part and the locking part are configured to be releasably connectable to one another in a positive and/or non-positive locking manner.

14. The apparatus according to claim 13, wherein the coupling sides in the connected state of the head part are in releasable engagement with the locking part.

15. The apparatus according to claim 13, wherein at least one securing element is configured and adapted for releasable locking in place of the head part with the locking part.

16. The apparatus according to claim 15, wherein the securing element is constructed in a plane perpendicular to a plane of rotation of the drill pipe.

17. The apparatus according to claim 12, wherein the locking part has a greater surface hardness as compared with the head part.

18. A drilling assembly for ground boring, comprising a drilling drive, at least one drill pipe having radially extending locking openings and an apparatus for connecting the drill pipe to the drilling drive according to claim 1.

* * * * *